US009646462B2

(12) United States Patent
Wright et al.

(10) Patent No.: US 9,646,462 B2
(45) **Date of Patent: *May 9, 2017**

(54) METHOD AND APPARATUS FOR AWARDING AT LEAST ONE JACKPOT PRIZE

(71) Applicant: Paltronics Australasia Pty Limited, Taren Point (AU)

(72) Inventors: Dean Wright, Emu Plains (AU); Stephen Cowen, Woronora Heights (AU)

(73) Assignee: Paltronics Australasia Pty Limited, Taren Point (AU)

( * ) Notice: Subject to any disclaimer, the term of this patent is extended or adjusted under 35 U.S.C. 154(b) by 0 days.

This patent is subject to a terminal disclaimer.

(21) Appl. No.: 13/782,644

(22) Filed: Mar. 1, 2013

(65) Prior Publication Data

US 2014/0080589 A1 Mar. 20, 2014

Related U.S. Application Data

(63) Continuation-in-part of application No. 13/045,062, filed on Mar. 10, 2011, now Pat. No. 8,840,463.

(30) Foreign Application Priority Data

Mar. 10, 2010 (AU) ..... 2010900988
Mar. 5, 2012 (NZ) ..... 598568

(51) Int. Cl.
*G07F 17/32* (2006.01)

(52) U.S. Cl.
CPC ..... *G07F 17/3258* (2013.01); *G07F 17/3225* (2013.01)

(58) Field of Classification Search
CPC ..... G07F 17/3258
(Continued)

(56) References Cited

U.S. PATENT DOCUMENTS 5,564,700 A 10/1996 Celona
6,210,275 B1 4/2001 Olsen
(Continued)

FOREIGN PATENT DOCUMENTS

AU 649512 5/1994
AU 716299 2/2000
(Continued)

OTHER PUBLICATIONS

US 8,393,959, 03/2013, Wright et al. (withdrawn)
(Continued)

*Primary Examiner* — Ronald Laneau
(74) *Attorney, Agent, or Firm* — Garrett IP, LLC

(57) ABSTRACT

At step 40 the parameters for the jackpot are initialized, including a storage criterion and an award criterion. At step 41 the current value of the jackpot prize pool is calculated. At step 42 the CPU 2 checks whether the storage criterion has been met. If so, the currently accumulated value of the jackpot prize pool is stored at step 43 in memory 6 as a pending jackpot, along with the award criterion that is associated with that pending jackpot. The jackpot parameters are then redefined and the accumulation of as new jackpot prize pool is ready to commence. A number of pending jackpots may be concurrently stored in memory 6, each with an associated stored award criterion. At step 46 the CPU 2 determines if any of the award criterions that are associated with the pending jackpots have been met and if so, the associated pending jackpot prize is awarded at step 47 in accordance with a jackpot prize distribution scheme.

25 Claims, 4 Drawing Sheets

(58) Field of Classification Search
USPC ..... 345/16–26; 463/16–26
See application file for complete search history.

(56) References Cited

U.S. PATENT DOCUMENTS

| | | | | |
|---|---|---|---|---|
| 6,565,434 | B1 | 5/2003 | Acres | |
| 7,828,645 | B2 | 11/2010 | Walker et al. | |
| 7,867,078 | B2 * | 1/2011 | Duhamel | 463/20 |
| 7,997,974 | B2 * | 8/2011 | Walker et al. | 463/20 |
| 8,142,283 | B2 | 3/2012 | Lutnick et al. | |
| 8,840,463 | B2 | 9/2014 | Wright et al. | |
| 2008/0026834 | A1 | 1/2008 | Yoshizawa | |
| 2008/0318656 | A1 * | 12/2008 | Walker et al. | 463/20 |
| 2011/0118000 | A1 | 5/2011 | Jaffe et al. | |
| 2012/0009993 | A1 | 1/2012 | Wright et al. | |

FOREIGN PATENT DOCUMENTS

| | | | |
|---|---|---|---|
| AU | 199910969 | | 8/2002 |
| AU | 2002367823 | | 7/2006 |
| AU | 2007231793 | | 5/2008 |
| WO | 9419074 | A1 | 9/1994 |
| WO | 95/05876 | A1 | 3/1995 |
| WO | 96/24421 | A1 | 8/1996 |
| WO | 99/21630 | A1 | 5/1999 |
| WO | 2005/008514 | A1 | 1/2005 |
| WO | 2005/016471 | A1 | 2/2005 |
| WO | 2005/029422 | A1 | 3/2005 |
| WO | 2005/029423 | A1 | 3/2005 |
| WO | 2005021117 | A2 | 3/2005 |
| WO | 2005/033825 | | 4/2005 |

OTHER PUBLICATIONS

Notice of Acceptance received for Australian Patent Application No. 2011200979, mailed on Oct. 1, 2013, 2 pages.

Second Patent Examination Report received for Australian Patent Application No. 2011200979, issued on Jun. 18, 2013, 3 pages.

Office Action Response filed in Australian application No. 2011200979, filed on May 17, 2013, 17 pages.

Office Action Response filed in Australian application No. 2011200979, filed on Sep. 3, 2013, 4 pages.

* cited by examiner

METHOD AND APPARATUS FOR AWARDING AT LEAST ONE JACKPOT PRIZE

CROSS REFERENCE TO RELATED APPLICATIONS

This application claims priority to New Zealand Patent Application No. 598568, filed Mar. 5, 2012, and is a continuation-in-part of U.S. Utility patent application Ser. No. 13/045,062, filed Mar. 10, 2011, which claims priority to Australia Patent Application No. 2010900988, filed Mar. 10, 2010, all of which are incorporated by reference herein in their entireties.

TECHNICAL FIELD

The present invention relates to a method of awarding at least one jackpot prize. It also relates to associated apparatus such as controllers and gaming systems. Embodiments of the present invention find application, though not exclusively, in the gaming industry for use in the context of linked networks of electronic gaming machines, such as slot machines for example. Embodiments of the present invention are typically deployed in establishments that provide gaming facilities, such as casinos, pubs, clubs and the like.

BACKGROUND

It is known to link a number of electronic gaming machines to form a network. Such networks may be linked to a controller, such as a server, to provide a secondary game such as a jackpot game in which each of the linked electronic gaming machines may participate. This secondary game is typically provided in addition to the primary game of the electronic gaming machines, which may for example be slots, poker, blackjack, bingo, keno, or the like. The players of the linked electronic gaming machines each contribute to, and may win, a jackpot prize.

An example of a prior art arrangement in which more than one player may win any one jackpot is provided by granted Australian Patent No. 2002367823 in the name of IGT. As disclosed predominantly at pages 30 to 32, this prior art document discloses a system in which the jackpot is divided into a winner's jackpot and a distributed jackpot. Each player of an active gaming machine at the time of the triggering of the jackpot may share in the distributed jackpot.

Another prior art example of a jackpot arrangement is provided by pending Australian patent application no. 2007231793 in the name of IGT. In embodiments of this prior art arrangement the award triggering event may occur at a different time to the player triggering event. Information indicative of either the amount of the award, or the winning player, is stored until the other has been determined. This prior art arrangement allows for each player who contributes to the progressive award to be eligible to win that progressive award, even if that player is not playing one of the gaming machines in the gaming system.

Any discussion of documents, acts, materials, devices, articles or the like which has been included in this specification is solely for the purpose of providing a context for the present invention. It is not to be taken as an admission that any or all of these matters form part of the prior art base or were common general knowledge in the field relevant to the present invention as it existed in Australia or elsewhere before the priority date of this application.

SUMMARY

It is an object of the present invention to overcome, or substantially ameliorate, one or more of the disadvantages of the prior art, or to provide a useful alternative.

In one aspect of the present invention there is provided a processor-implemented method of awarding at least one jackpot prize, the method including:

- defining processor-accessible parameters for a jackpot, said parameters including a storage criterion;
- defining a processor-accessible award criterion for the jackpot, wherein the award criterion is defined as the receipt of a signal from one of a plurality of electronic gaming machines, said signal being indicative of, or associated with, a request for the award of a pending jackpot and wherein at least one of the electronic gaming machines is configured to send the signal in response to a generation by a game of at least one trigger condition;
- using the processor to accumulate a jackpot prize pool in dependence upon a gaming activity of the plurality of electronic gaming machines;
- using the processor to store the jackpot prize pool as a pending jackpot prize, re-defining the jackpot storage criterion and resetting the jackpot prize pool in response to a satisfaction of the storage criterion; and
- using the processor to award at least one of the pending jackpot prizes to at least one recipient in accordance with a jackpot prize distribution scheme in response to a satisfaction of the award criterion.

Preferably the jackpot prize distribution scheme defines that the pending jackpot is awarded to the player of the electronic gaming machine that generated the signal.

In one embodiment the at least one electronic gaming machine is operable to place a main bet on the game and to optionally place a side bet and wherein the jackpot prize distribution scheme defines that a player must have placed a side bet in order to be eligible to be a recipient of the award of a pending jackpot.

Preferably the at least one trigger condition is a game result having a predefined combination of symbols.

In a second aspect of the present invention there is provided a processor-implemented method of awarding at least one jackpot prize, the method including:

- defining processor-accessible parameters for a jackpot, said parameters including a storage criterion;
- defining a processor-accessible award criterion for the jackpot, wherein the award criterion is defined with reference to a player tracking system;
- using the processor to accumulate a jackpot prize pool in dependence upon a gaming activity of the plurality of electronic gaming machines;
- using the processor to store the jackpot prize pool as a pending jackpot prize, re-defining the jackpot storage criterion and resetting the jackpot prize pool in response to a satisfaction of the storage criterion; and
- using the processor to award at least one of the pending jackpot prizes to at least one recipient in accordance with a jackpot prize distribution scheme in response to a satisfaction of the award criterion.

Preferably the award criterion is defined with reference to a statistic associated with the player tracking system.

In a third aspect of the present invention there is provided a processor-implemented method of awarding at least one jackpot prize, the method including:

defining processor-accessible parameters for a jackpot, said parameters including a storage criterion;

defining a processor-accessible award criterion for the jackpot, wherein the award criterion is defined with reference to a determination that a current time is equal to a target time;

using the processor to accumulate a jackpot prize pool in dependence upon a gaming activity of the plurality of electronic gaming machines;

using the processor to store the jackpot prize pool as a pending jackpot prize, re-defining the jackpot storage criterion and resetting the jackpot prize pool in response to a satisfaction of the storage criterion; and using the processor to award at least one of the pending jackpot prizes to at least one recipient in accordance with a jackpot prize distribution scheme in response to a satisfaction of the award criterion.

Preferably the target time is randomly selected.

Preferably the jackpot prize distribution scheme is defined with reference to a player tracking system.

Preferably the jackpot prize distribution scheme defines that a player must be registered for participation in the player tracking system in order to be eligible to be a recipient of the award of a pending jackpot. In one embodiment each player participating in the player tracking system is allocated a player identifier and the jackpot prize distribution scheme defines that a player must have used the player identifier to identify his or her self to the player tracking system in order to be eligible to be a recipient of the award of a pending jackpot. In this embodiment the player identifier is preferably a player tracking card and the jackpot prize distribution scheme defines that a player must be playing an electronic gaming machine that is operatively associated with the player's player tracking card in order to be eligible to be a recipient of the award of a pending jackpot.

In one embodiment the at least one pending jackpot prize is awarded to the at least one recipient in the form of a cash prize or an equivalent credit amount. In another embodiment the at least one pending jackpot prize is awarded to the at least one recipient in the form of an amount of points credited to a recipient's points account. Another embodiment includes receiving a signal generated in response to an input by the recipient so as to specify a form in which the recipient desires to receive the at least one pending jackpot prize. Yet another embodiment allows an operator to specify a form in which the at least one pending jackpot prize is to be provided to the at least one recipient.

An embodiment further includes providing a recipient of a pending jackpot prize with an option to play a further game whereby all of, or a portion of, a value of the awarded pending jackpot prize is used as a stake.

Preferably "storing the jackpot prize pool as a pending jackpot prize" is accompanied by storing an award criterion that is associated with the stored pending jackpot prize.

Another aspect of the present invention provides a controller being programmed to perform a method as described above, said controller including:

a processor;

a memory operatively coupled to the processor; and a communications link for communication with the plurality of electronic gaming machines.

The features and advantages of the present invention will become further apparent from the following detailed description of preferred embodiments, provided by way of example only, together with the accompanying drawings.

DETAILED DESCRIPTION

At least some embodiments of the invention make use of certain elements of hardware and software similar to that disclosed in Patent Application No. PCT/AU2004/000964 (published on 27 Jan. 2005 as WO/2005/008514), the disclosure of which is incorporated herein by way of reference.

Figure 1:
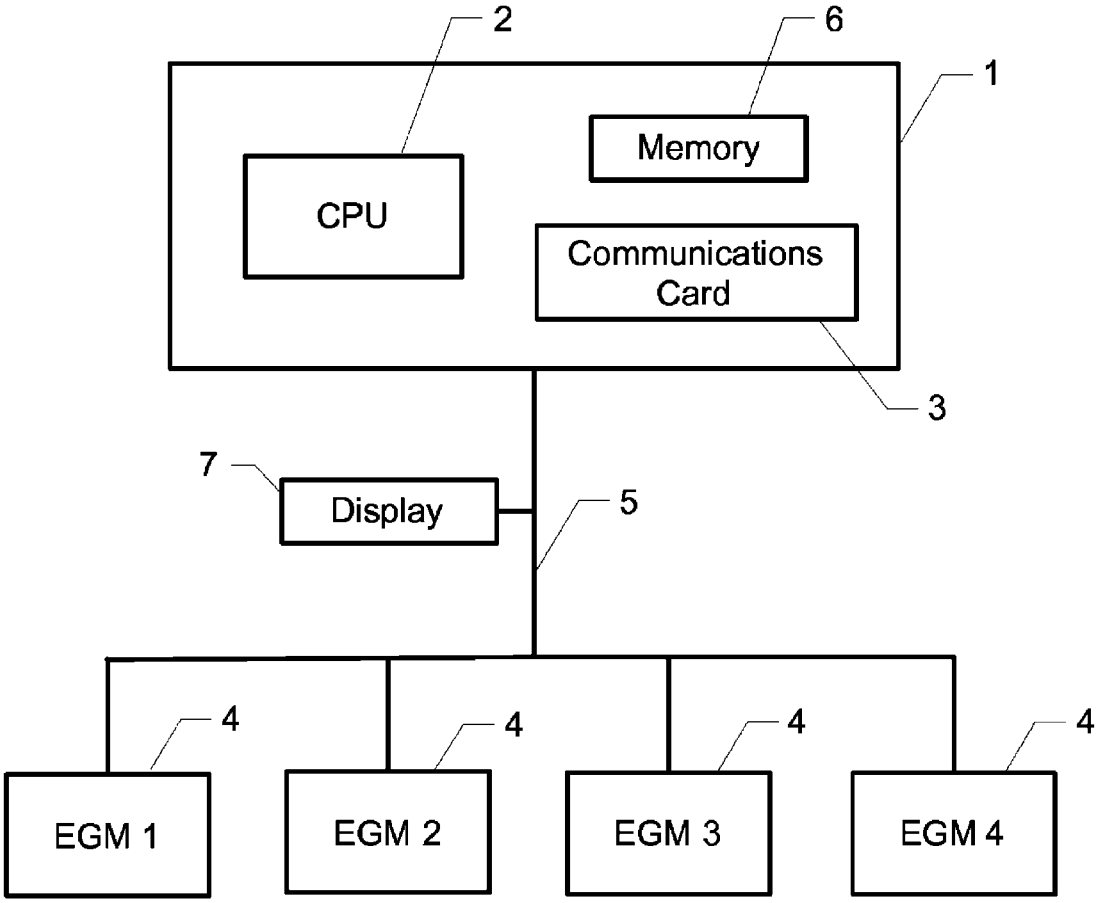
FIG. 1 is a schematic representation of an embodiment of the present invention.

Referring to FIG. 1, the controller 1 has a central processing unit (CPU) 2 and a communications card 3 that is operatively coupled to the CPU 2 and which communicatively links the controller 1 to a plurality of electronic gaming machines (EGM's) 4. In some embodiments the communications link 5 is provided by cables, a wireless link, a local area network, a wide area network, or a combination thereof. The EGM's 4 may be located within a single establishment, or may be located in two or more geographically dispersed locations. Also operatively coupled to the CPU 2 is memory 6, which is typically in the form of random access memory or other readable and writable digital storage media such as hard drives, flash drives, and the like.

In some embodiments the CPU 2 is programmed to perform the inventive method by means of computer executable code stored on a computer readable medium, such as a CD-ROM, for example. In other embodiments the executable code is accessed either by means of downloading a file from a remote location, for example via the internet, or by means of remote execution, such as in a so-called "cloud computing" context.

Figure 3:
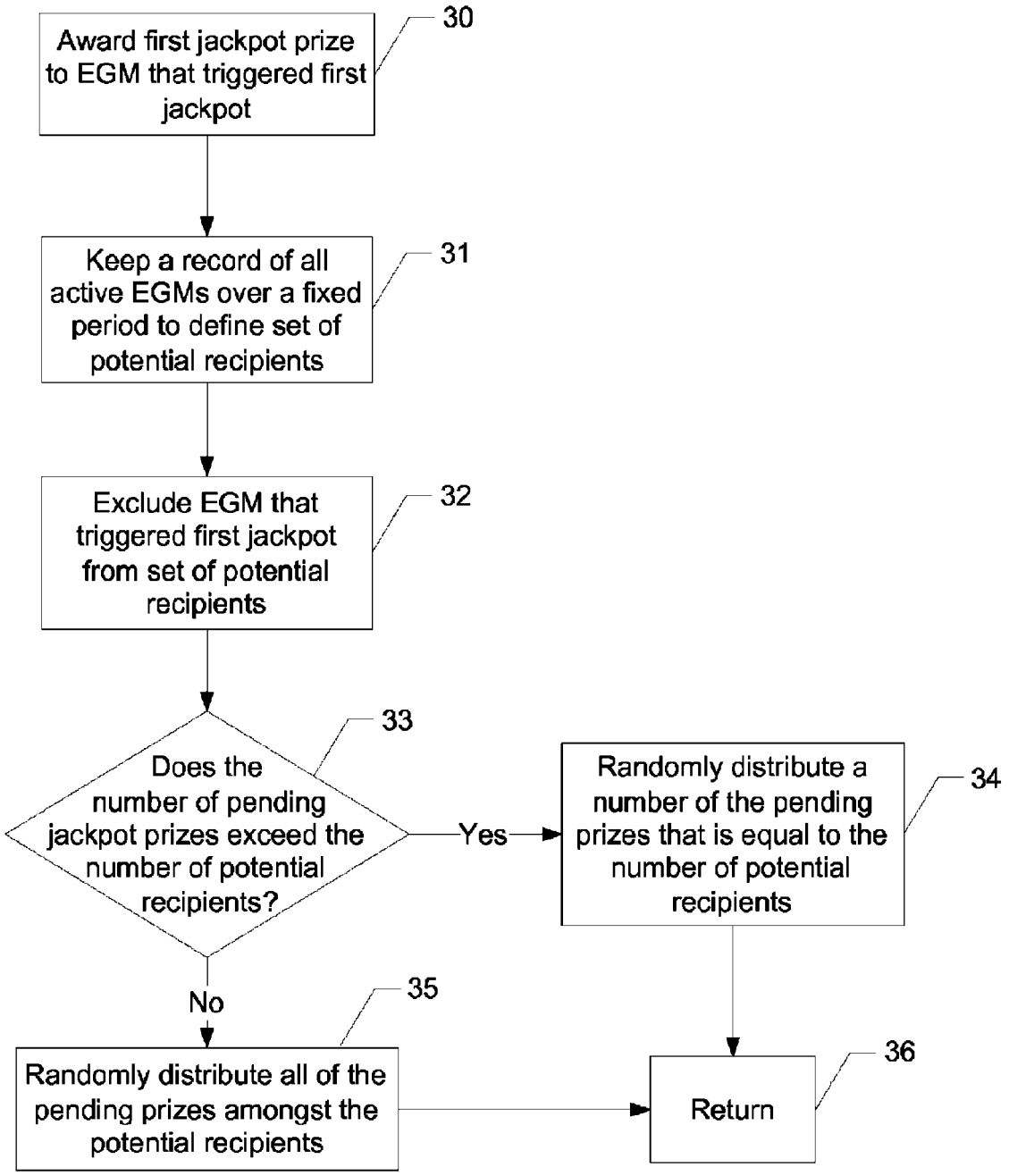
FIG. 3 is a flowchart showing steps performed in a jackpot prize distribution scheme of an embodiment of the inventive method.

As will be described in greater detail below, the controller 1 is programmed to conduct a first jackpot that has an award criterion and a second jackpot that has a storage criterion. The CPU 2 maintains variables that represent first and second jackpot prize pools, which are progressively accumulated based upon gaming activity as communicated by the EGM's 4 to the controller 1. The progressive accumulation of the first and second jackpot pools eventually satisfies either or both of the award criterion and the storage criterion. Each time the storage criterion is satisfied the controller 1 stores the current value of the second jackpot prize pool in memory 6. This value is typically an amount of currency that may be expressed in dollars and cents and, once stored in this fashion, is referred to as a "pending jackpot prize". At this point the pending jackpot prize has not been allocated to any particular player, but rather is simply allocated to the controller 1. The CPU 2 then resets the second jackpot and continues with the progressive accumulation of the first and second jackpot pools. Upon satisfaction of the award criterion the controller 1 awards the first jackpot prize pool, along with one or more of any pending jackpot prizes, to at least one recipient in accordance with a jackpot prize distribution scheme. An example of such a jackpot prize distribution scheme is shown in FIG. 3 and is described in greater detail below.

The CPU 2 has access to display driver software that is executable to cause the display 7 to display various messages to the players of the EGM's 4. In some embodiments the CPU is programmed to cause the display 7 to display the current values of the first jackpot prize pool and/or the values of any pending jackpot prizes.

Figure 2:
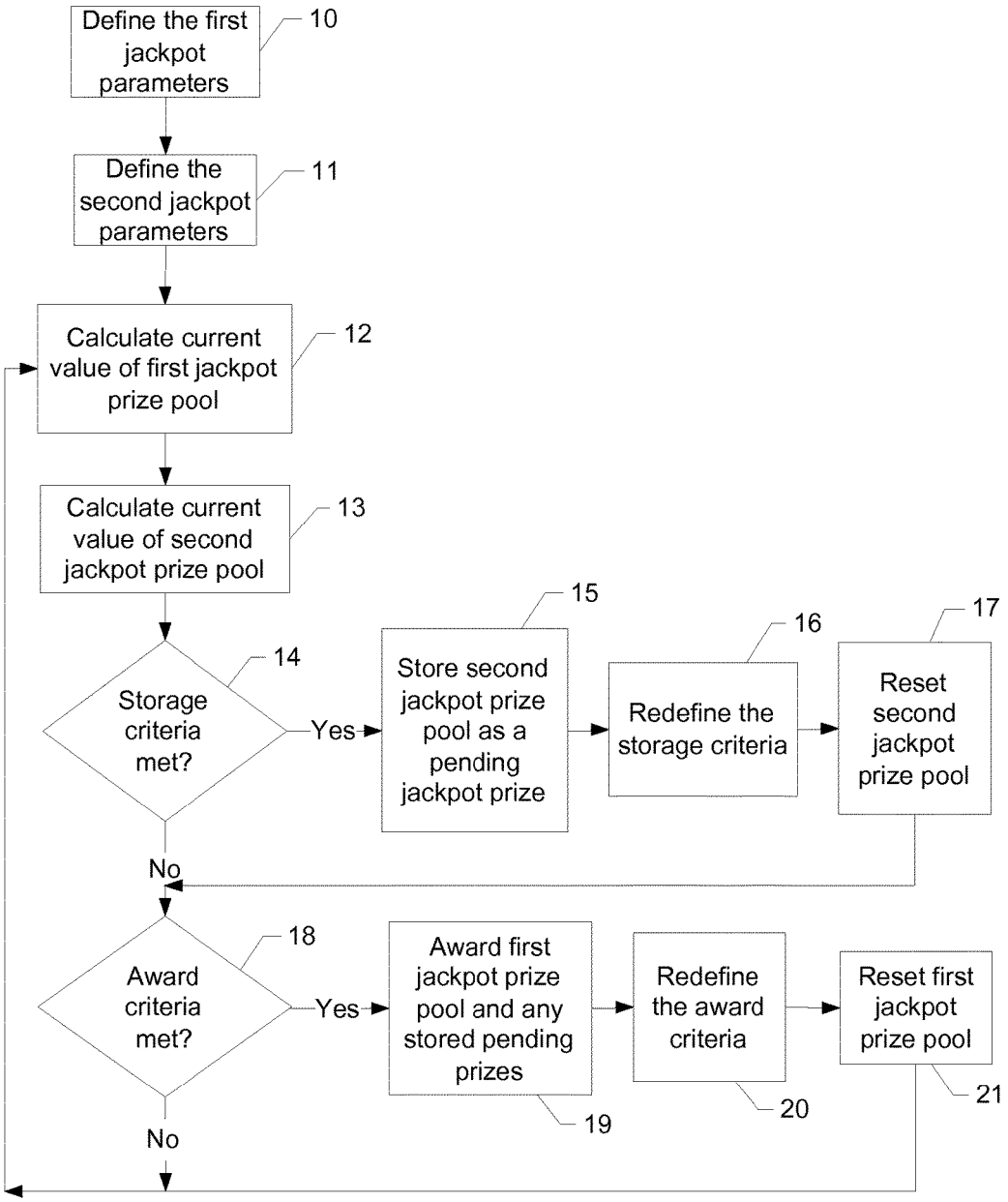
FIG. 2 is a flowchart showing steps performed in an embodiment of the inventive method.

With reference to FIG. 2, the method commences with some initialization steps 10 and 11, which include defining the parameters for the first and second jackpots respectively. In an exemplary implementation of an embodiment of the invention this includes the following:

| First Jackpot | |
|---|---|
| Minimum First Jackpot Prize = | $100.00 |
| Maximum First Jackpot Prize = | $200.00 |
| First Jackpot Increment % = | 0.5% |
| First Jackpot Startout % = | 1.0% |
| First Jackpot Mystery Value = | A randomly or pseudo-randomly defined value within the range defined by the Minimum First Jackpot Value and the Maximum First Jackpot Value. |

| Second Jackpot | |
|---|---|
| Minimum Second Jackpot Prize = | $10.00 |
| Maximum Second Jackpot Prize = | $20.00 |
| Second Jackpot Increment % = | 0.25% |
| Second Jackpot Startout % = | 0.5% |
| Second Jackpot Mystery Value = | A randomly or pseudo-randomly defined value within the range defined by the Minimum Second Jackpot Value and the Maximum Second Jackpot Value. |

The first jackpot mystery value defines the award criterion in so far as the award of jackpot prizes takes place once the first jackpot prize pool has been progressively incremented so as to equal, or exceed, the first jackpot mystery value. Similarly, the second jackpot mystery value defines the storage criterion because the second jackpot prize pool is stored as a pending jackpot prize once the second jackpot prize pool has been progressively incremented so as to equal, or exceed, the second jackpot mystery value.

These first and second jackpot parameters are selected such that an expected second jackpot triggering rate (i.e. the rate at which the award criterion is satisfied) exceeds an expected first jackpot triggering rate (i.e. the rate at which the storage criterion is satisfied). More particularly, the average statistical expectation based upon these parameters is that approximately five pending jackpots would be stored for each time that the award criterion is met.

It will be appreciated by those skilled in the art that the Return-To-Player percentages (RTP %) of the first and second jackpots are given by an addition of the relevant increment and startout percentages. Hence, for the first jackpot in the exemplary implementation, the RTP %=1.5% and for the second jackpot in the exemplary implementation, the RTP %=0.75%.

The process flow then proceeds into a loop which commences at step 12 at which a current value of the first jackpot prize pool is calculated by the CPU 2. This calculation takes place in a known manner whereby the previous value of the first jackpot prize pool is incremented by the first jackpot increment percentage multiplied by the turnover of the various linked EGM's 4 that has been communicated by the EGM's 4 to the controller 1 since the last such calculation was made.

At step 13 the CPU performs a similar calculation to determine the current value of the second jackpot prize pool. The previous value of the second jackpot prize pool is incremented by the second jackpot increment percentage multiplied by the turnover of the various linked EGM's that has been communicated by the EGM's to the controller 1 since the last such calculation was made.

The process flow then proceeds to step 14 at which the CPU 2 determines whether the storage criterion has been met by checking whether the second jackpot prize pool has a value equal to, or greater than, the second mystery value. If so, the process flow moves to steps 15, 16 and 17. If not, the process flow moves directly to step 18.

At step 15 the current value of the second jackpot prize pool is stored in a memory address of the memory 6 as a "pending prize". If the storage criterion is satisfied a number of times before the award criterion is satisfied, this will result in a number of pending prizes being stored concurrently at separate memory addresses of the memory 6.

Steps 16 and 17 effectively reset the second jackpot. At step 16 the storage criterion is redefined by the random or pseudo-random determination of a new second mystery value. At step 17 the second jackpot prize pool is reset to the minimum second jackpot prize, which in the exemplary implementation is $10.00. After step 17 the process flow moves to step 18.

At step 18 the CPU 2 determines whether the award criterion has been met by ascertaining whether the current value of the first jackpot prize pool is equal to, or greater than, the first jackpot mystery value. If so, the CPU stores in memory 6 an EGM identifier record that is indicative of the specific EGM 4 that made the contribution that caused the first jackpot mystery value to increment to a value equal to, or greater than, the first jackpot mystery value and then the process flow moves to step 19. If the award criterion has not been met then the process flow loops back to step 12.

At step 19 the CPU 2 executes a routine that results in the award of the first jackpot prize pool, along with one or more of any pending jackpot prizes, to the players in accordance with a jackpot prize distribution scheme. More particularly, the CPU 2 awards the first jackpot prize pool to the EGM that was recorded at step 18. It also awards one or more of any pending jackpot prizes to some of the players in a manner outlined in more detail below with regard to FIG. 3. Once awarded, the pending jackpot prizes are deleted from the memory 6.

After the award of the prizes, the process flow moves to step 20, at which the award criterion is redefined by randomly or pseudo-randomly determining a new value for the first jackpot mystery value. At step 21 the first jackpot prize pool is reset to the minimum first jackpot prize value, which in the exemplary implementation is $100. Having reset the first jackpot, the process flow loops back to step 12.

The processing that takes place at step 19 during the processing of the jackpot prize distribution scheme is shown in more detail in FIG. 3. Once the CPU 2 has ascertained that the award criterion has been satisfied, it awards the first jackpot prize pool to the player of the EGM 4 that made the contribution that satisfied the award criterion. In other words, the first jackpot prize pool is awarded to the player of the EGM 4 that triggered the first jackpot. This is shown as step 30 in FIG. 3. The CPU 2 then proceeds to step 31, at which it monitors and records all of the active EGM's 4 for a fixed period, which in the exemplary embodiment is 3.5 seconds from the triggering of the first jackpot prize. Hence, for this 3.5 second period, the CPU stores a record in its memory 6 of the EGM identifiers that are associated with each EGM that communicates to the controller 1 that it has made a contribution to the first and second jackpot pools. This commences the definition of the set of potential recipients of the pending prizes.

Once the 3.5 seconds have elapsed the CPU executes a routine that removes any double-entries from the list of potential recipients, so that each potential recipient is listed once only on the record of potential recipients that is kept in the memory 6. However, it will be appreciated that this routine may be dispensed with for implementations in which such doubling-up is allowable.

The process flow then moves to step 32, at which if necessary the EGM identifier of the EGM that triggered the first jackpot is removed from the set of potential recipients of the pending prizes. In other words, the player of the EGM that was awarded the first jackpot prize is excluded from the possibility of also winning any of the pending prizes. However, it will be appreciated that other embodiments of the invention may be configured to allow this possibility simply by removing step 32 from the process flow.

The process flow now moves to step 33, at which the CPU 2 compares the number of pending jackpot prizes that are stored in the memory 6 to the number of potential recipients in the record. This comparison is carried out because the jackpot prize distribution scheme of the illustrated embodiment defines that the number of pending jackpot prizes that are available to be awarded cannot exceed the number of players in the set of potential recipients. If the number of pending jackpot prizes exceeds the number of potential recipients, then the process flow moves to step 34; whereas if not the process flow moves to step 35.

At step 34 the CPU awards a number of pending prizes that is equal to the number of potential recipients. Hence, by way of example, if at step 34 there are eight pending prizes and only five potential recipients, then only five of the pending prizes are available to be awarded. The remaining three pending prizes continue to be stored and may be awarded to players upon a subsequent satisfaction of the award criterion. For this embodiment the CPU 2 is configured to drive the display 7 such that only the values of the pending prizes that are available to be awarded are displayed to the players. Hence, in the example above, the values of only five of the pending prizes would be displayed, despite eight pending prizes being stored, because there are only five potential recipients and therefore only five pending prizes that are available to be awarded. In some embodiments the five pending prizes may be respectively distributed to each of the five potential recipients. However, in the illustrated embodiment the five pending prizes are randomly or pseudo-randomly distributed amongst the five potential recipients such that it is possible for some of the potential recipients to receive more than one pending prize, whilst others may receive none. Once the pending prizes have been distributed at step 34, the process flow moves to step 36, at which the process flow returns to step 20 of FIG. 2.

At step 35 the CPU distributes the pending prizes in a context in which the number of pending jackpot prizes does not exceed the number of potential recipients. This entails a random or pseudo-random distribution of the pending prizes amongst the potential recipients. By way of example, for a situation in which there are three pending prizes and ten potential recipients, the CPU randomly or pseudo-randomly selects three of the ten potential recipients and awards one of the three pending prizes to each of them. Once the pending prizes have been distributed at step 35, the process flow moves to step 36, at which the process flow returns to step 20 of FIG. 2.

Alternative embodiments of the invention dispense with steps 33 and 34 and simply randomly or pseudo-randomly distribute all of the pending prizes amongst the potential recipients, irrespective of whether there may be more pending prizes than potential recipients.

It will be appreciated that embodiments of the invention advantageously allow the entity deploying the system to select from amongst a range of pre-approved sets of parameters. This allows for a selection of the desired average performance of the first and second jackpots from that provided by the available sets of parameters. For example, an alternative embodiment of the invention utilizes parameters that give rise to a statistical expectation that the prizes awarded by the second jackpot will be on average larger and less frequent as compared to those awarded by the first jackpot. Two such sets of parameters are as follows:

| First Jackpot | |
|---|---|
| Minimum First Jackpot Prize = | $100.00 |
| Maximum First Jackpot Prize = | $200.00 |
| First Jackpot Increment % = | 0.5% |
| First Jackpot Startout % = | 1.0% |
| First Jackpot Mystery Value = | A randomly or pseudo-randomly defined value within the range defined by the Minimum First Jackpot Value and the Maximum First Jackpot Value. |

| Second Jackpot | |
|---|---|
| Minimum Second Jackpot Prize = | $1000.00 |
| Maximum Second Jackpot Prize = | $2000.00 |
| Second Jackpot Increment % = | 0.75% |
| Second Jackpot Startout % = | 1.5% |
| Second Jackpot Mystery Value = | A randomly or pseudo-randomly defined value within the range defined by the Minimum second Jackpot Value and the Maximum Second Jackpot Value. |

Using these parameters, the first jackpot RTP %=1.5% and the second jackpot RTP %=2.25%.

During the operation of the embodiment that utilizes the above parameters, it is likely that the first jackpot will be awarded a number of times without any pending jackpots having been stored. However, once the second jackpot reaches its storage criterion (i.e. once the second jackpot prize pool equals or exceeds the second jackpot mystery value) the second jackpot is stored as a pending jackpot, which is subsequently awarded to a player when the next first jackpot is triggered.

In each of the above described embodiments the triggering of the award of one or more of the pending jackpots has been dependent upon the triggering of the award of the first jackpot. However, in the alternative embodiment illustrated in FIG. 4, alternative criteria may be used to trigger the award of one or more of the pending jackpots. This embodiment accrues only a single jackpot at any one point in time (as opposed to the first and second jackpots that accrue concurrently in the embodiments described above).

Figure 4:
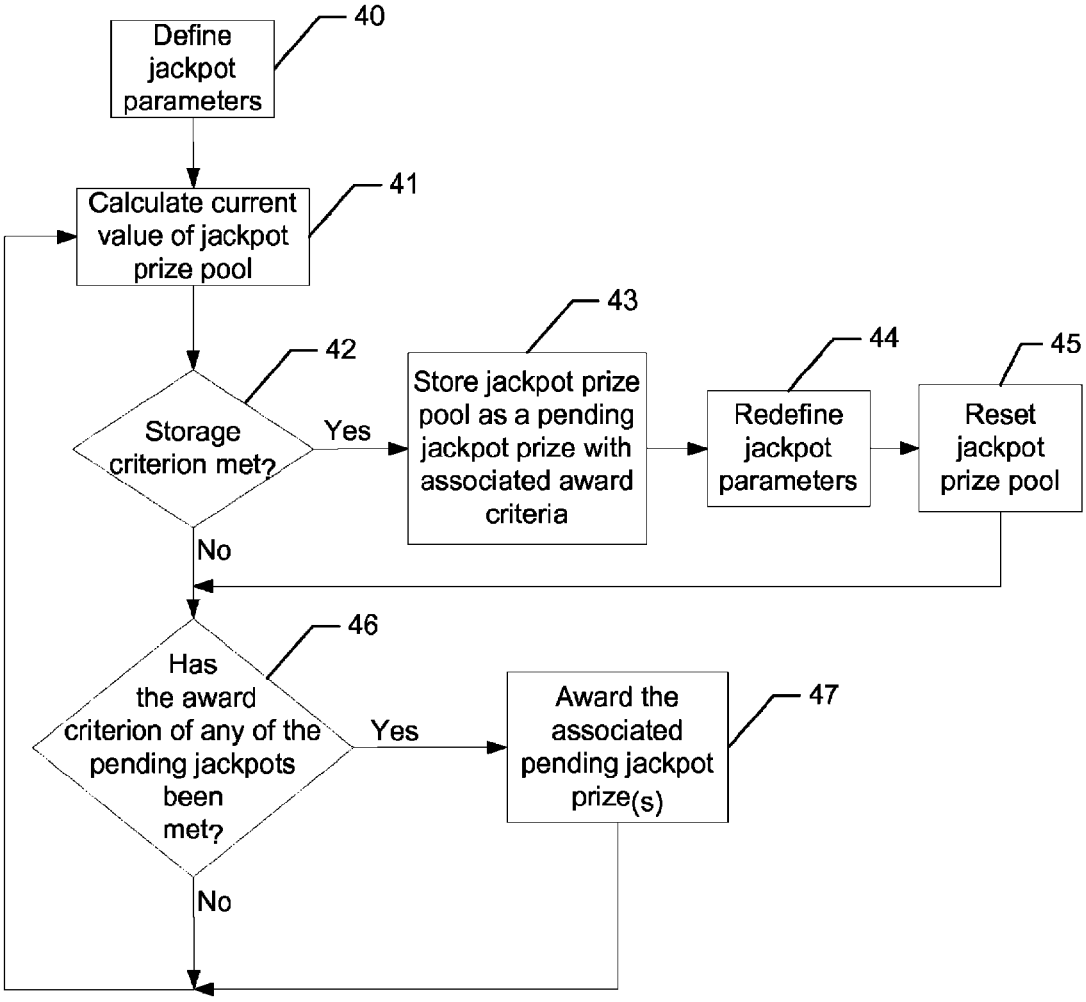
FIG. 4 is a flowchart showing steps performed in another embodiment of the inventive method.

The method employed by the embodiment of FIG. 4 commences at step 40 with the initial definition of parameters for the jackpot. These parameters include a storage criterion, which is defined with reference to a jackpot mystery value. The parameters also include an award criterion, which may be based on an extraneous occurrence, as will be described in more detail below. In alternative embodiments, the award criterion is determined at a later stage in the process, such as after the pending jackpot prize with which it is associated has been stored.

At step 41 the current value of the jackpot prize pool is calculated. The first time the process loops through step 41, the jackpot prize pool is initialized to a start up value in a manner that is well known to those skilled in the art. On subsequent occasions when the process flow loops through step 41, the jackpot prize pool is incremented using turnover contributions from each of the active EGM's 4. Hence, the jackpot prize pool progressively accumulates.

At step 42 the CPU 2 checks whether the storage criterion has been met by checking whether the jackpot prize pool has been incremented so as to equal, or exceed, the jackpot mystery value. If not the process flow proceeds to step 46. If so, the process flow proceeds to step 43 at which the currently accumulated value of the jackpot prize pool is stored in memory 6 as a pending jackpot. The CPU 2 also causes the award criterion for that pending jackpot to be stored in memory 6. Once the pending jackpot has been stored, the jackpot parameters are redefined at step 44, including the determination of a new jackpot mystery value and the reinitializing of the jackpot prize pool to a new start up value at step 45. Hence the accumulation of as new jackpot prize pool is ready to commence.

It is eventually possible for a number of pending jackpots to be concurrently stored in memory 6, each with an associated stored award criterion. The following table shows some non-limiting example of such conditions:

| Pending Jackpot Prize | Associated Award Condition |
|---|---|
| $24.40 | Receipt of a signal from an EGM indicating that a primary game result included a predefined combination of symbols. |
| $59.14 | Receipt of a signal from the Player Tracking System indicating that a player has played at a rate that exceeds a threshold. |
| $9.56 | A determination by the Controller 1 that the current time is equal to a randomly selected time. |

Each of the above example pending jackpot prizes remains stored in the memory 6 until its associated award condition is met. During this period the existence of the pending jackpots may be disclosed to the players of the EGM's via the display 7, if such is desired by the gaming venue management.

At step 46 the CPU 2 determines if any of the award criterions that are associated with the pending jackpots have been met. If not, the process flow loops back to step 41. If so, the pending jackpot prize that is associated with the award criteria that has been met is awarded at step 47 in accordance with a jackpot prize distribution scheme. The memory 6 is then updated to indicate that the associated pending jackpot prize has been awarded and to indicate that it is therefore no longer necessary to check its award criterion when the process flow next returns to step 46. The process flow then loops back to step 41.

An example of an award criterion that may be defined in association with at least one of the pending jackpots is the receipt by the controller 1 of a signal from one of the EGM's 4 whereby the signal is indicative of, or associated with, a request for the award of a pending jackpot. In this embodiment the EGM's 4 are programmed to generate such a signal whenever a game being played on the EGM generates a trigger condition, such as a game that results in a pre-defined combination of bonus symbols, for example. The EGM 4 then sends the signal to the controller 1. Upon receipt of the signal, the controller 1 is programmed to award the associated pending jackpot to the player in accordance with a jackpot prize distribution scheme, which, in one embodiment, simply awards the relevant pending jackpot to the player of the EGM 4 that generated and sent the signal.

In other embodiments the jackpot prize distribution scheme dictates that a player other than the player of the EGM 4 that generated and sent the signal may receive the associated pending jackpot prize. In one such embodiment each of the EGM's 4 is operable by its player to place a main bet on the game and the EGM 4 also gives the player the option to place a side bet. The jackpot prize distribution scheme defines that a player must have placed a side bet in order to be eligible to be a recipient of the award of a pending jackpot. Hence, if a player who has not placed a side bet causes an EGM 4 to generate a triggering condition, then the associated pending jackpot prize is awarded to another player of another EGM 4 on which such a side bet has been placed. The recipient is selected by the controller by reviewing a log of turnover contributions to find the most recent EGM 4 that made a turnover contribution on a game for which a side bet was placed and the associated pending jackpot prize is awarded to the player of that EGM 4.

Another example of an award criterion that may be defined in association with at least one of the pending jackpots makes use of known player tracking systems that are capable of keeping track of a number of statistics associated with at least some of the players of the EGM's 4. In one such embodiment the award criterion is dependent on a statistic that is associated with the number of games played by a player over a given time period. If this number exceeds a pre-determined threshold, the player tracking system communicates a request for the award of a pending jackpot to the controller 1.

In another embodiment the jackpot prize distribution scheme is defined with reference to the player tracking system, however the award criterion is not. For example, in one embodiment the jackpot prize distribution scheme defines that a player must be registered for participation in the player tracking system in order to be eligible to be a recipient of the award of a pending jackpot. If a player who is not registered for participation in the player tracking system causes the award criteria to be met, then the controller 1 reviews the log of turnover contributions to select another player who is registered to receive the associated pending jackpot prize.

In a typical implementation of a player tracking system, each player intending to participate in the player tracking system is allocated a player identifier in the form of a player tracking card. The jackpot prize distribution scheme defines that a player must be playing an EGM 4 with which the player tracking card is operatively associated (for example by insertion of the player tracking card into a slot provided in the EGM 4), so as to identify the player to the player tracking system in order for the player to be eligible to be a recipient of the award of a pending jackpot.

When the associated pending jackpot prize (i.e. the prize that is associated with the award criteria that has been met at step 46) is awarded to the recipient at step 47, it may be awarded in the form of a cash prize, an equivalent credit amount or an amount of promotional points credited to a recipient's points account. In one embodiment each EGM 4 includes input means (such as physical buttons, touch screen buttons, a joy stick, a scroll bar, etc) to allow the recipient to specify in which of the available forms the recipient desires to receive the associated pending jackpot prize. In response to the recipient's operation of the input means, the EGM 4 generates and sends a signal to the controller 1, which identifies the player's selected form. The controller 1 is programmed to respond to such a signal by awarding the associated pending jackpot prize to the recipient in the selected form. In an alternative embodiment the controller 1 is configured by the operator (i.e. the gaming venue management) to specify the form in which the associated pending jackpot prize is to be provided to recipients. For example, the gaming venue management may choose to define that any recipient who has a points account should receive their pending jackpot prize as a points credit to their account; whereas any player who does not have a points account should receive their pending jackpot prize in the form of EGM credit. In yet another embodiment, the form selected by the operator is presented to the recipient as a default, which is only overridden if the recipient uses their EGM's input means to vary the default form within a predefined length of time.

In some embodiments the recipient of the pending jackpot prize is provided with an option to play a further game. (The standard game provided by the EGM may be referred to as the primary game; the game that has the potential to award the pending jackpots may be referred to as the secondary game; and the further game that may be played by a recipient of a pending jackpot may be referred to as the tertiary game). The option to play the tertiary game is shown on the screen of the recipient's EGM 4 and the recipient uses the EGM's input means to choose whether or not to accept. In some such tertiary games all of the value of the awarded pending jackpot prize is used as a stake for the tertiary game. In other embodiments the player is given the option to stake a portion of the value of the awarded pending jackpot prize. A typical example of such a tertiary game would be a 'double-up' type game, which is well known to those skilled in the art. However, it will be appreciated that other types of tertiary games may be provided instead.

Advantageously, some embodiments of the invention may be implemented in a manner that makes effective use of existing linked jackpot systems and processes. Typically only minimal changes are required to reconfigure such existing systems to perform in accordance with the embodiment of the invention. Additionally, many embodiments of the invention require only minimal changes to existing reconciliation and reporting functions that may already be in place in the venues that provide existing linked jackpot systems. Another advantage associated with some embodiments of the invention is a simplification of the selection of the jackpot parameters.

While a number of preferred embodiments have been described, it will be appreciated by persons skilled in the art that numerous variations and/or modifications may be made to the invention without departing from the spirit or scope of the invention as broadly described. The present embodiments are, therefore, to be considered in all respects as illustrative and not restrictive.

Methods and systems are disclosed herein with the aid of functional building blocks illustrating functions, features, and relationships thereof. At least some of the boundaries of these functional building blocks have been arbitrarily defined herein for the convenience of the description. Alternate boundaries may be defined so long as the specified functions and relationships thereof are appropriately performed. While various embodiments are disclosed herein, it should be understood that they are presented as examples. The scope of the claims should not be limited by any of the example embodiments disclosed herein, or by references to any of the terms "invention," "step," "preference," or "preferably," in the specification.

One or more features disclosed herein may be implemented in, without limitation, circuitry, a machine, a computer system, a processor and memory, a computer program encoded within a computer-readable medium to cause a processor to perform actions and/or functions, and/or combinations thereof.

What is claimed is:

1. A processor-implemented method of awarding at least one jackpot prize, the method including:

defining processor-accessible parameters for a jackpot, said parameters including a storage criterion;

defining a processor-accessible award criterion for the jackpot, wherein the award criterion is defined as the receipt of a signal from one of a plurality of electronic gaming machines, said signal being indicative of, or associated with, a request for the award of a pending jackpot and wherein at least one of the electronic gaming machines is configured to send the signal in response to a generation by a game of at least one trigger condition;

using the processor to accumulate a jackpot prize pool in dependence upon a gaming activity of the plurality of electronic gaming machines, said gaming activity being in response to inputs made by users of the electronic gaming machines;

using the processor to store the jackpot prize pool as a pending jackpot prize, re-defining the jackpot storage criterion and resetting the jackpot prize pool in response to a satisfaction of the storage criterion; and using the processor to award at least one of the pending jackpot prizes to at least one recipient in accordance with a jackpot prize distribution scheme in response to a satisfaction of the award criterion.

2. A method according to claim 1 wherein the jackpot prize distribution scheme defines that the pending jackpot is awarded to the player of the electronic gaming machine that generated the signal.

3. A method according to claim 1 wherein the at least one electronic gaming machine is operable to place a main bet on the game and to optionally place a side bet and wherein the jackpot prize distribution scheme defines that a player must have placed a side bet in order to be eligible to be a recipient of the award of a pending jackpot.

4. A method according to claim 1 wherein the at least one trigger condition is a game result having a predefined combination of symbols.

5. A processor-implemented method of awarding at least one jackpot prize, the method including:

defining processor-accessible parameters for a jackpot, said parameters including a storage criterion;

defining a processor-accessible award criterion for the jackpot, wherein the award criterion is defined with reference to a player tracking system;

using the processor to accumulate a jackpot prize pool in dependence upon a gaming activity of the plurality of electronic gaming machines, said gaming activity being in response to inputs made by users of the electronic gaming machines;

using the processor to store the jackpot prize pool as a pending jackpot prize, re-defining the jackpot storage criterion and resetting the jackpot prize pool in response to a satisfaction of the storage criterion; and using the processor to award at least one of the pending jackpot prizes to at least one recipient in accordance with a jackpot prize distribution scheme in response to a satisfaction of the award criterion.

6. A method according to claim 5 wherein the award criterion is defined with reference to a statistic associated with the player tracking system.

7. A processor-implemented method of awarding at least one jackpot prize, the method including:

defining processor-accessible parameters for a jackpot, said parameters including a storage criterion;

defining a processor-accessible award criterion for the jackpot, wherein the award criterion is defined with reference to a determination that a current time is equal to a target time;

using the processor to accumulate a jackpot prize pool in dependence upon a gaming activity of the plurality of electronic gaming machines, said gaming activity being in response to inputs made by users of the electronic gaming machines;

using the processor to store the jackpot prize pool as a pending jackpot prize, re-defining the jackpot storage criterion and resetting the jackpot prize pool in response to a satisfaction of the storage criterion; and using the processor to award at least one of the pending jackpot prizes to at least one recipient in accordance with a jackpot prize distribution scheme in response to a satisfaction of the award criterion.

8. A method according to claim 7 wherein the target time is randomly selected.

9. A method according to claim 5 wherein the jackpot prize distribution scheme is defined with reference to a player tracking system.

10. A method according to claim 9 wherein the jackpot prize distribution scheme defines that a player must be registered for participation in the player tracking system in order to be eligible to be a recipient of the award of a pending jackpot.

11. A method according to claim 9 wherein each player participating in the player tracking system is allocated a player identifier and wherein the jackpot prize distribution scheme defines that a player must have used the player identifier to identify his or her self to the player tracking system in order to be eligible to be a recipient of the award of a pending jackpot.

12. A method according to claim 11 wherein the player identifier is a player tracking card and wherein the jackpot prize distribution scheme defines that a player must be playing an electronic gaming machine that is operatively associated with the player's player tracking card in order to be eligible to be a recipient of the award of a pending jackpot.

13. A method according to claim 1 wherein the at least one pending jackpot prize is awarded to the at least one recipient in the form of a cash prize or an equivalent credit amount.

14. A method according to claim 1 wherein the at least one pending jackpot prize is awarded to the at least one recipient in the form of an amount of points credited to a recipient's points account.

15. A method according to claim 1 including receiving a signal generated in response to an input by the recipient so as to specify a form in which the recipient desires to receive the at least one pending jackpot prize.

16. A method according to claim 1 including allowing an operator to specify a form in which the at least one pending jackpot prize is to be provided to the at least one recipient.

17. A method according to claim 1 further including providing a recipient of a pending jackpot prize with an option to play a further game whereby all of, or a portion of, a value of the awarded pending jackpot prize is used as a stake.

18. A method according to claim 1 wherein "using the processor to store the jackpot prize pool as a pending jackpot prize" is accompanied by the storing of an award criterion that is associated with the stored pending jackpot prize.

19. A controller being programmed to perform a method according to claim 1 or claim 5 or claim 7, said controller including:

a processor;

a memory operatively coupled to the processor; and a communications link for communication with the plurality of electronic gaming machines.

20. A non-transitory computer readable medium encoded with a computer program, including instructions to cause a processor to:

define jackpot parameters that include a storage criterion;

define an award criterion for the jackpot as the receipt of a signal from one of a plurality of electronic gaming machines, said signal being indicative of, or associated with, a request for the award of a pending jackpot and wherein at least one of the electronic gaming machines is configured to send the signal in response to a generation by a game of at least one trigger condition;

accumulate a jackpot prize pool in dependence upon a gaming activity of the plurality of electronic gaming machines, said gaming activity being in response to inputs made by users of the electronic gaming machines;

store the jackpot prize pool as a pending jackpot prize, re-define the jackpot storage criterion and reset the jackpot prize pool in response to a satisfaction of the storage criterion; and award at least one of the pending jackpot prizes to at least one recipient in accordance with a jackpot prize distribution scheme in response to a satisfaction of the award criterion.

21. The non-transitory computer readable medium of claim 20, further including instructions to cause the processor to award at least one of the pending jackpot prizes to a player of the electronic gaming machine that generated the signal.

22. A non-transitory computer readable medium encoded with a computer program, including instructions to cause a processor to:

define jackpot parameters that include a storage criterion;

define award criterion for the jackpot, wherein the award criterion is defined with reference to a player tracking system;

accumulate a jackpot prize pool in dependence upon a gaming activity of the plurality of electronic gaming machines, said gaming activity being in response to inputs made by users of the electronic gaming machines;

store the jackpot prize pool as a pending jackpot prize, re-define the jackpot storage criterion and reset the jackpot prize pool in response to a satisfaction of the storage criterion; and award at least one of the pending jackpot prizes to at least one recipient in accordance with a jackpot prize distribution scheme in response to a satisfaction of the award criterion.

23. The non-transitory computer readable medium of claim 22, further including instructions to cause the processor to define the jackpot prize distribution scheme such that a player must be registered for participation in the player tracking system in order to be eligible to be a recipient of the award of a pending jackpot.

24. A non-transitory computer readable medium encoded with a computer program, including instructions to cause a processor to:

define jackpot parameters that include a storage criterion;

define an award criterion for the jackpot wherein the award criterion is defined with reference to a determination that a current time is equal to a target time;

accumulate a jackpot prize pool in dependence upon a gaming activity of the plurality of electronic gaming machines, said gaming activity being in response to inputs made by users of the electronic gaming machines;

store the jackpot prize pool as a pending jackpot prize, re-define the jackpot storage criterion and reset the jackpot prize pool in response to a satisfaction of the storage criterion; and award at least one of the pending jackpot prizes to at least one recipient in accordance with a jackpot prize distribution scheme in response to a satisfaction of the award criterion.

25. The non-transitory computer readable medium of claim 24, further including instructions to cause the processor to randomly select the target time.

* * * * *